United States Patent [19]

Engel

[11] Patent Number: 4,991,065

[45] Date of Patent: Feb. 5, 1991

[54] LIGHTING SYSTEM

[76] Inventor: Hartmut S. Engel, Schloss Heutingsheim, 7141 Freiberg am Neckar, Fed. Rep. of Germany

[21] Appl. No.: 369,106

[22] Filed: Jun. 21, 1989

[30] Foreign Application Priority Data

Jun. 21, 1988 [DE] Fed. Rep. of Germany ..... 3820926

[51] Int. Cl.[5] ..... F21V 13/00

[52] U.S. Cl. ..... 362/33; 362/278; 362/282; 362/320; 362/322; 362/431; 362/449

[58] Field of Search ..... 362/18, 33, 277, 282, 362/319, 320, 322, 323, 347, 431, 449, 234, 278

[56] References Cited

U.S. PATENT DOCUMENTS 3,851,164 11/1974 Intrator ..... 362/18 X 4,524,405 6/1985 Heard ..... 362/347 X

*Primary Examiner*—Stephen F. Husar

[57] ABSTRACT

A lighting system is described for the uniform illumination of restricted working surfaces in which a large area reflector is used which partially spans the working surface and which is for example positioned above the head height of a standing person. This large area reflector is mounted on a vertical support which simultaneously carries the light source required to irradiate this large area reflector.

17 Claims, 4 Drawing Sheets

LIGHTING SYSTEM

Figure 1:
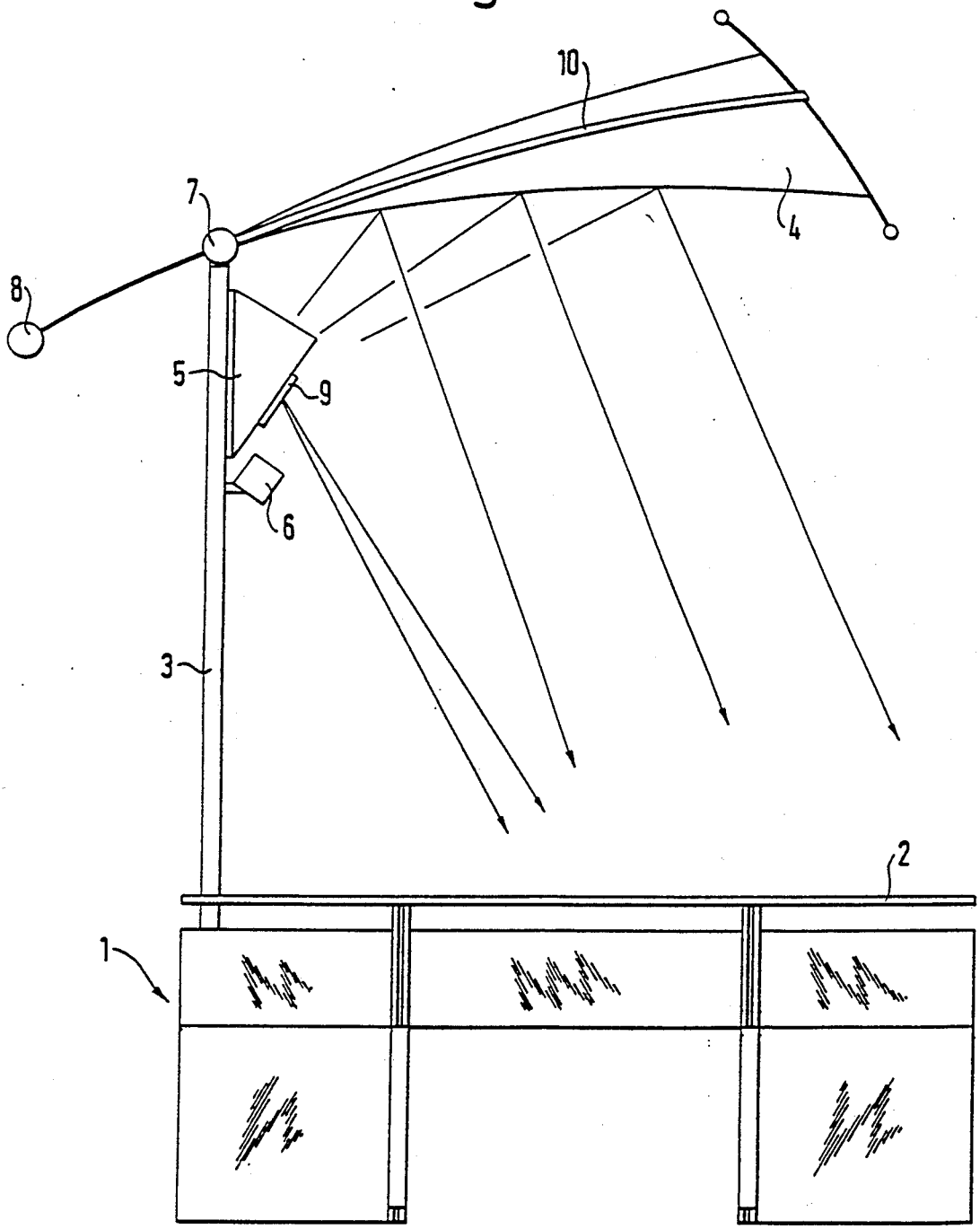

The invention relates to a lighting system, in particular for the uniform illumination of restricted working surfaces comprising at least one light source and at least one reflector associated with the latter.

The lighting of working surfaces, in particular the lighting of individual working surfaces in the form of writing tables, computer workplaces and the like places considerable requirements on the respective light planning, which can frequently only be satisfied with difficulty and not ideally as a result of constructional circumstances, of inadequate basic electrical installation and also of the variation possibilities which are frequently required with regard to the workplace arrangements.

Known lighting systems do not normally permit individual adaption of the lighting to the respective workplace, are of frequently critical with respect to the freedom from glare required for computer workplaces and do not generally permit any variation of the position of the workplaces without impairing the quality of illumination of the relevant workplace.

Individual workplace lighting arrangements not only impair the useful size of the working surface which is available, but rather generally do not result in a uniform illumination of the entire working surface. With such systems glare effects frequently also arise with display screens, which is very undesirable.

The object of the invention is to develop a lighting system in such a way that an ideal glare-free illumination of the particular workplace can be achieved without the requirement for light planning which takes into account the whole working space, and without having to tolerate a restriction of the useful area of the working surface. The lighting system should moreover be suitable for individualisation of the individual workplace and should not be impaired in its effectiveness even if changes have to be effected in the prevailing positions of the workplaces.

This object is satisfied in accordance with the invention essentially in that the reflector is formed as a large area reflector which at least partially spans the respective working surface and which is held on a vertical carrier; and in that at least one light source which radiates towards the large area reflector is mounted on a vertical carrier in the region between the working surface and the large area reflector.

Through the use of a large area reflector related to the working surface it is possible to achieve an ideal and uniform, in particular an indirect illumination of the respective working surface independently of the particular room, and in particular independently of the height of the room, and indeed while simultaneously minimizing the energy that is required for this purpose and while avoiding any form of glare effects.

As a result of the arrangement and layout of this large area reflector, and of the use of the vertical support to hold the large area reflector and to hold the light source associated with the latter, it is possible to select the radiation angle such that, on the one hand, no form of glare effects occur and, on the other hand, so that the best possible light yield is achieved via the reflection, with the usable size of the working surface itself not being impaired by the lighting system in any manner.

As a result of the full area illumination related to the workplace there is also no need for the light planning which would otherwise be necessary for the particular room, and no form of difficulties arise when changing around the working furniture, since the lighting system automatically moves with the furniture and is in no way impaired in its function at a new location.

A lighting system in accordance with the invention can take the best possible account of individual circumstances and desires with respect to workplace illumination since, in accordance with an advantageous embodiment, the large area reflector is made adjustable on the vertical support with respect to its spacing from and/or inclination to the working surface, and above all its curvature is variable so that the desired uniformity of the working surface illumination, and also the desired brightness can in any event be achieved, and indeed individually for the particular workplace and independently of neighbouring workplaces.

The vertical support advantageously comprises mutually couplable and fixable individual portions, with these individual portions being combinable in any desired manner from support portions and supporting functional portions for light sources and ballasts. The couplings between the individual portions are preferably formed as mechanically stable plug, latch or threaded connections, and are preferably provided with electrical coupling units which necessarily ensure the required electrical connections on effecting the mechanical coupling.

It is particularly advantageous to provide a mechanical/electrical interface in a corner or edge region of the particular working furniture, in particular of the working table, with which the vertical support can be coupled. In doing so one has to ensure, on the one hand, that the necessary mechanical strength is obtained and, on the other hand, that trouble-free electrical contact is ensured while observing the existing safety regulations. By way of example the mechanical coupling can take place via conically inter-engaging elements, with the electrical connecting parts being concentrically disposed and with the form and force locked connection between the two mechanical parts to be coupled being achieved via a threaded sleeve. The electrical connection elements can be used in this arrangement in pin/-socket form or also in the form of concentric contact elements.

When using vertical supports of rectangular cross-section and correspondingly shaped interfaces a diagonal subdivision can be provided in such a manner that then a mechanically stable triangular support, which accommodates all mechanical loads, can be combined with a likewise triangular receiving chamber for the electrical functional elements.

In accordance with a further layout of the invention provision is made that the light source associated with the large area reflector is simultaneously combined with at least one direct spot light, or at least one direct light source or a light source which provides both direct light and also indirect light via the large area reflector. If required a separate further auxiliary light source which is likewise preferably mounted on the vertical support can be used in addition to this light source. In all cases the brightness is preferably so selected that direct light and reflected light have the same brightness on the working surface, and thus that the typical softness of indirect light and also the required freedom from shadows is achieved over the entire working surface.

Further particular advantageous embodiments of the inventions are set forth in the subordinate claims.

Figure 2:
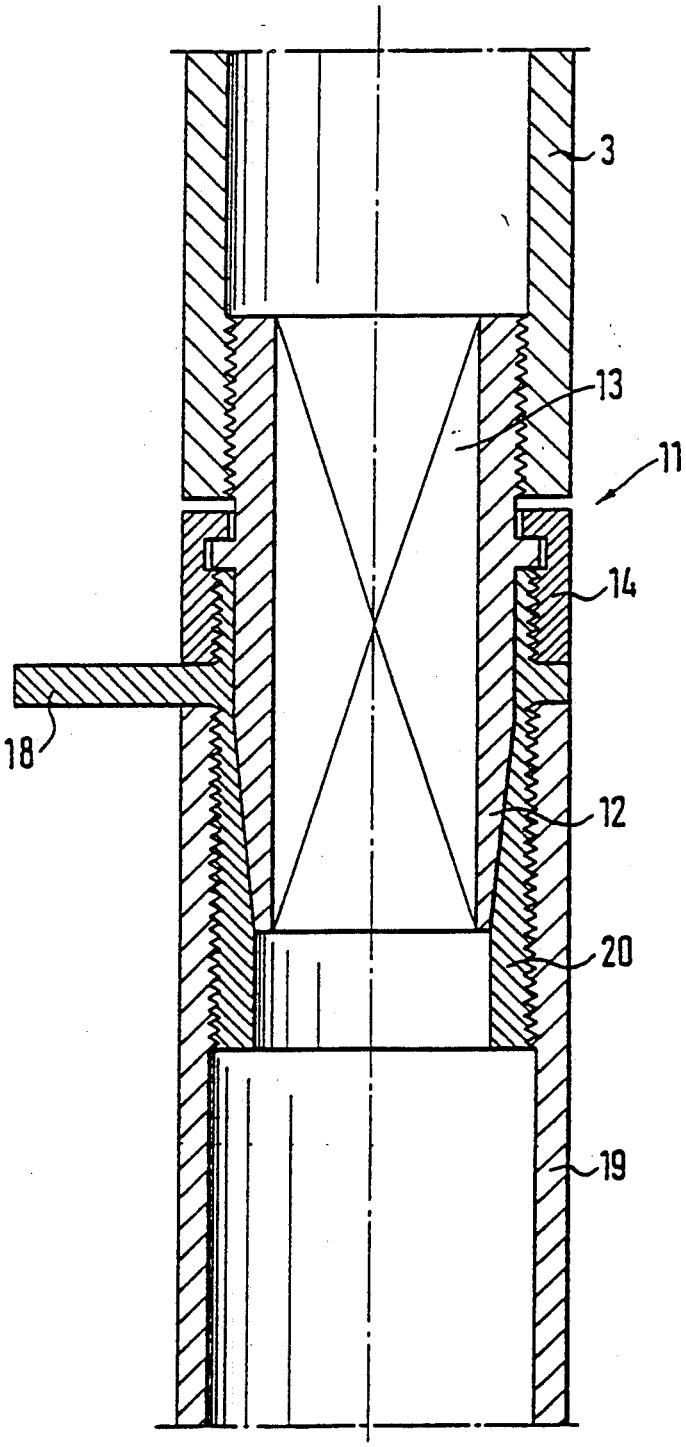
Figure 3:
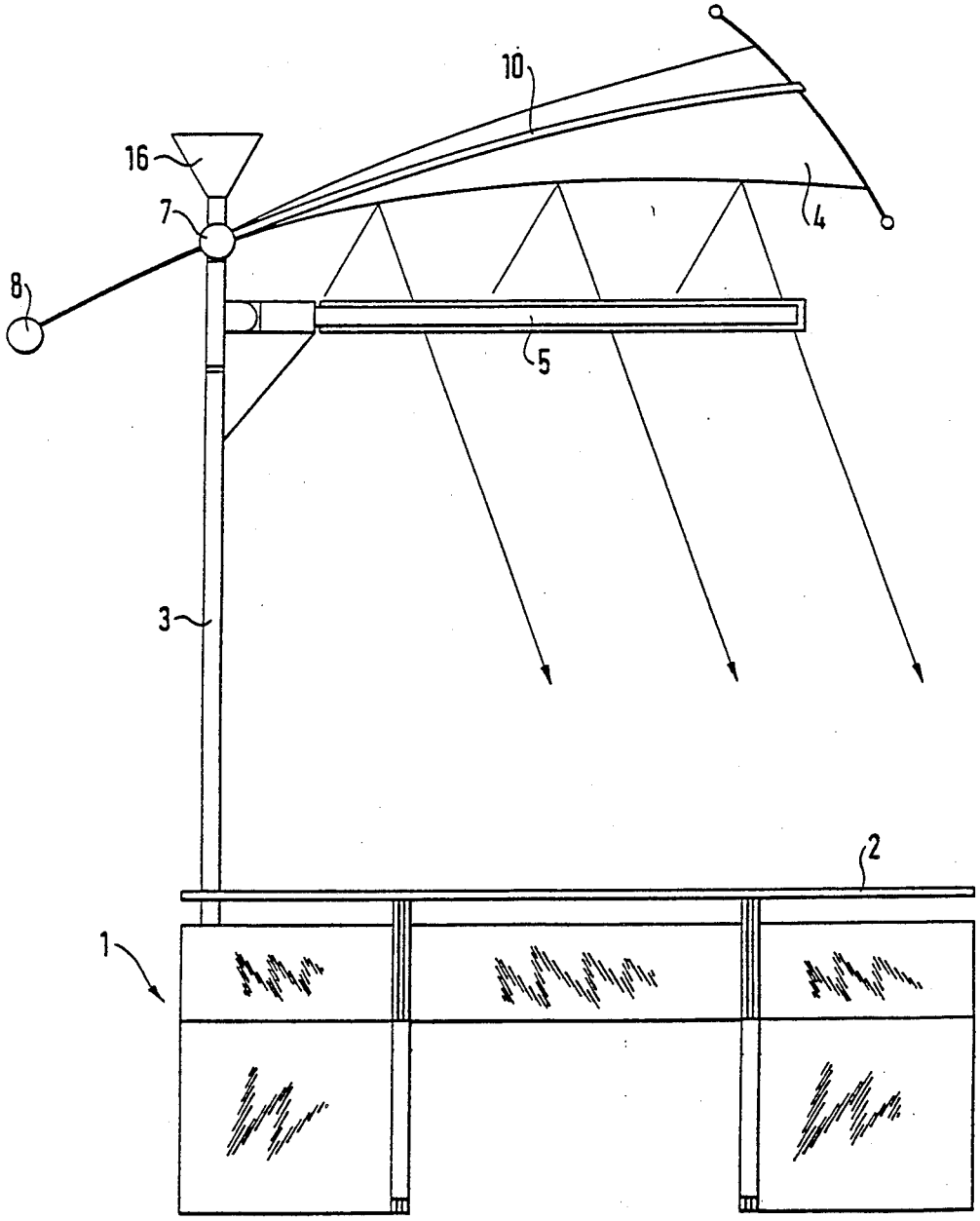
Figure 4:
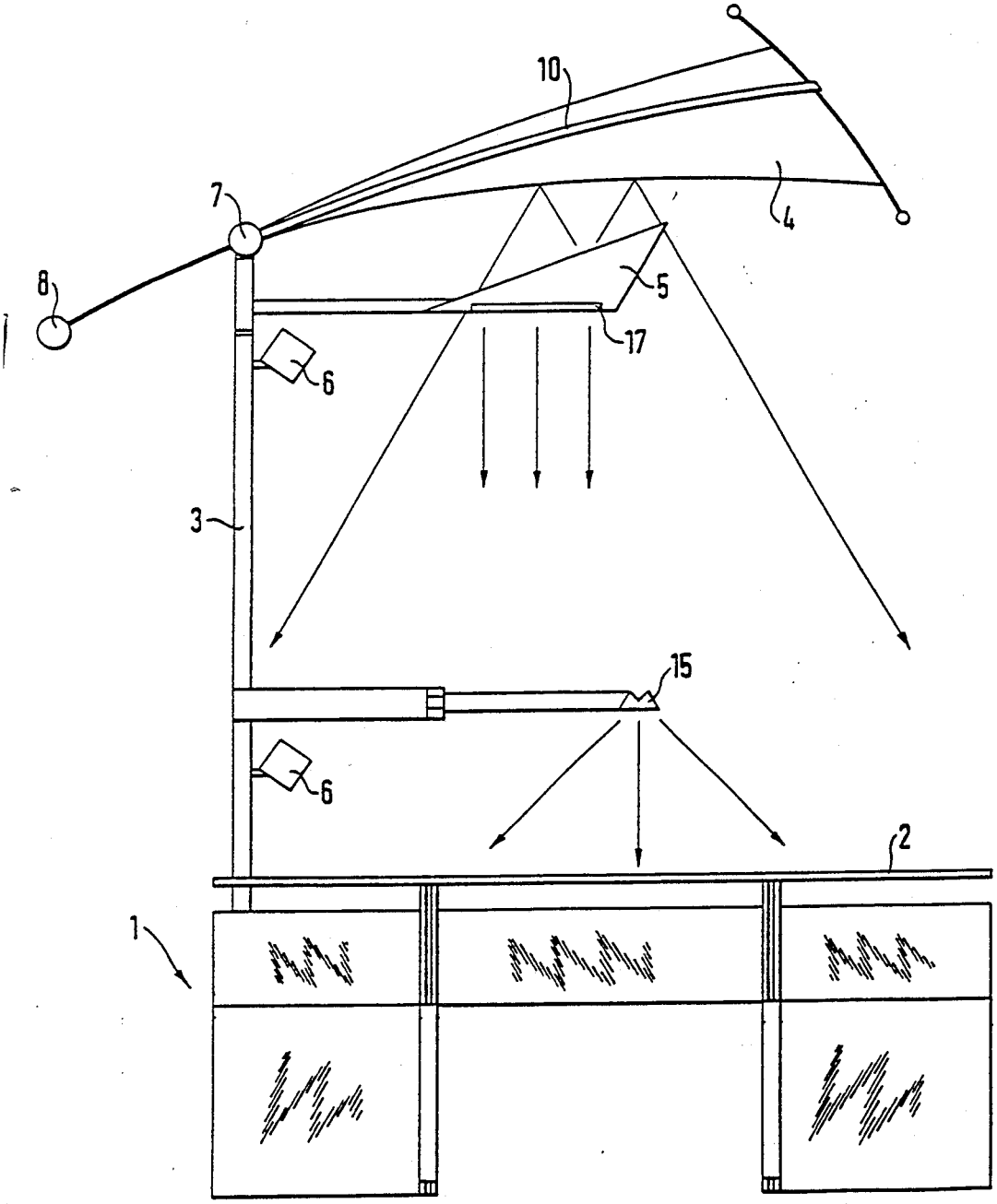

The invention will now be described in more detail with respect to embodiments and with reference to the drawing in which are shown:

FIG. 1 a schematic illustration of a first embodiment of a lighting system in accordance with the invention, FIG. 2 a schematic representation of an interface connection unit for integration into a piece of working furniture, FIG. 3 a variant of the lighting system of FIG. 1, and FIG. 4 a further embodiment with combined direct and indirect illumination of a working surface.

FIG. 1 shows as an example for a piece of working furniture a writing table 1 with a working surface 2. The working surface 2 is illuminated by means of the lighting system of the invention, which is individually matched to this working surface 2 in correspondence with the prevailing requirements, with indirect and direct light in an ideal manner so that no disturbing structures are present and no shadow formation occurs.

The lighting system includes a vertical support 3 which can be provided with a stable pedestal but which however is preferably directly coupled with the writing table 1 via an interface connection unit, and also includes a large area reflector 4 secured to the vertical support 3 and a light source 5 which radiates towards the large area reflector 4 at predeterminable angles.

If a ballast 6 is necessary for the light source 5 then this ballast 6 is preferably formed as a separate unit which is likewise mounted on the vertical support 3. This has the essential advantage that the ballast is not impaired by the heat development of the light source, which is of particular importance for electronic ballast devices and increases their ability to the function permanently.

The large area reflector 4 extends over a considerable part of the width of the working surface 2 and can for example be shaped in the form of an acute angled curved sail which is realized by means of a tensioning frame 10 which is covered with a suitable reflecting material.

The large area reflector 4 is preferably secured to the vertical column 3 via a fixable pivot or ball joint 7 and can be equipped with a suitable counterweight 8.

The fixable hinge 7 can be telescopically extendably mounted for the vertical adjustment of the large area reflector 4, however it is also possible to effect a vertical adjustment by the insertion of an intermediate piece, since the vertical support 3 preferably consists of individual sections which can be connected to one another in modular manner, in particular individual sections which can be screwed together, with individual sections having only a support function and also carrier sections in the form of function units being provided, with such a function unit including for example a light source or a ballast device.

The light source 5 can optionally also be combined with a direct spot light 9 which may optionally also be directably formed and can enable an additional small area illumination of the working surface with a brightness corresponding to the brightness of the indirect light.

FIG. 2 shows, in a strongly schematic manner, a possible embodiment of a connection or interface unit 11 such as can be integrated as a standard unit in a piece of working furniture in the edge or corner region, so that a lighting system of the invention can be attached without difficulties, and so that the required stability of the lighting system can be ensured by the coupling with the piece of working furniture.

The interface unit 11 is shown in the left-hand part of FIG. 2 in a first embodiment provided with a flange 18 and in the right-hand part in a second embodiment for a tube coupling which is free of a flange.

In both embodiments the tubular vertical support 3 is screwed to a coupling sleeve 12 and this coupling sleeve 12 has a conically tapering end which engages into a sleeve 18 of complementary shape which is either provided with a flange 18 or with an external screw thread and is fixable relative to the sleeve 20 by means of a clamping screw element 14. This clamping element 14 engages over a ring formation of the coupling sleeve 12 and makes it possible in this manner to achieve an extremely stable clamped fixation through a simple screw process. It is of advantage with this construction that the outer diameter of all the visible cylindrical parts is the same so that in the installed state there is a harmonizing connection of the respective vertical support 3 to the connection unit 11.

The embodiment of FIG. 3 is distinguished from the embodiment of FIG. 1 essentially in that a light source 5 in the form of a tube light is associated with the large area reflector 4, with the tube light extending over a substantial part of the width of the working surface 2 and optionally being screened off downwardly relative to the working surface 2 by a preferably adjustable shade.

Moreover, it is shown in FIG. 3 that an additional light source 16, for example in the form of a spot light, can be attached to the vertical support even above the large area reflector 4 in order to obtain a defined illumination of the room independently of the individual illumination of the workplace which is ensured by the lighting system of the invention.

FIG. 4 shows a further embodiment of the invention in which the light source 5 associated with the large area reflector 4 is spaced from the vertical support 3 and is so formed that a direct light source 17 can be effective approximately in the region of the center of the working surface 2.

The direct light source 17 is preferably identical, with respect to the light means that are used, with the light source used to generate the indirect light, and in this case a transparent region is provided at the working surface side, with the transparent region being so selected that at least substantially the same brightness is achieved at the working surface for the direct light and for the indirect light.

Moreover, it is shown in this representation that a direct light source 15 can, if desired, be alternatively or additionally integrated into the construction of the vertical support 3 which consists of individual sections, with the direct light source 15 being preferably horizontally pivotable and/or pivotable in a vertical plane and thus being selectively usable without impairing the useful working surface 2.

I claim:

1. An illuminating system, in particular for the uniform illumination of restricted working surfaces, including at least one light source and at least one reflector associated with the at least one light source, comprising:

a table having a working surface;

the reflector being formed as a large area reflector, said reflector at least partially spanning said working surface, said large area reflector including a frame covered with a reflecting material under tension;

a vertical carrier upon which said large area reflector is held, and upon which said table is secured to;

the at least one light source which radiates towards the large area reflector is mounted on said vertical carrier in the region between the working surface of said table and the large area reflector;

said large area reflector being formed as a triangular sail;

and one end of said sail having a bar and a tensioning member extending from the bar to an apex of said sail remote from the bar to mount said sail adjacent its apex on said vertical support.

2. Lighting system in accordance with claim 1, characterized in that the large area reflector (4) is adjustable on the vertical support (3) with respect to the spacing from and the inclination to the working surface (2).

3. Lighting system in accordance with claim 1, characterized in that the fixing hinge (7) is formed in the manner of a fixable pivot joint or ball joint.

4. Lighting system in accordance with claim 1 characterized in that the large area reflector (4) is provided with a counterweight (8) which is preferably adjustable relative to the fixing hinge (7).

5. Lighting system in accordance with claim 1 characterized in that the light source (5) is vertically adjustably and/or pivotally mounted and fixable on the vertical support (3).

6. Lighting system in accordance with claim 1 characterized in that a ballast (6) necessary for the particular light source (5) is formed as a separate unit which is likewise mounted on the vertical support (3).

7. Lighting system in accordance with claim 1 characterized in that the vertical support (3) comprises mutually couplable and fixable individual sections; and in that support sections and supporting functional sections for the light source (5) and ballast (6) are combinable as individual sections.

8. Lighting system in accordance with claim 1 characterized in that the vertical support (3) is at least capable of being mechanically coupled with a connection unit (11) provided in an edge region of the working surface or in a corner region of the working surface.

9. Lighting system in accordance with claim 8, characterized in that the connection unit (11) is formed as a mechanical/electrical interface.

10. Lighting system in accordance with claim 1 characterized in that a direct light source (15), in particular a direct light source which is horizontally and/or vertically pivotable is mounted on the vertical support (3) in the region between the working surface (2) and the light source (5) associated with the large area reflector (4).

11. An illuminating system, in particular for the uniform illumination of restricted working surfaces, including at least one light source and at least one reflector associated with the at least one light source, comprising:

a table having a working surface;

the reflector being formed as a large area reflector, said reflector at least partially spanning the working surface of said table;

a vertical carrier upon which said large area reflector is held, and upon which said table is secured to;

the at least one light source which radiates toward the large area reflector is mounted on said vertical carrier in the region between the working surface of said table and the large area reflector, said at least one light source associated with the large area reflector simultaneously has a direct light source which radiates toward the working surface of said table.

12. Light system in accordance with claim 11 characterized in that the light source associated with the large area reflector (4) is adjustable in its distance to the vertical support (3) by displacement and/or by pivoting.

13. Lighting system in accordance with claim 11 characterized in that the light source (5) associated with the large area reflector (4) is of tubular construction and extends, starting from the region of the vertical support (3) arranged to the side of the working surface (2) over at least the half of the width of the working surface.

14. Lighting system in accordance with claim 11 characterized in that the large area reflector (4) extends at least substantially over approximately $\frac{2}{3}$ of the width of the working surface (2).

15. Lighting system in accordance with claim 11 characterized in that the brightness of the indirect light directed towards the working surface (2) via the large area reflector (4) is at least substantially the same as the brightness of the light coming from a direct light source.

16. Lighting system in accordance with claim 11 characterized in that the terminal unit (11) for the interface installation is provided with a sleeve having a flange (18), with the sleeve having a conical mount for a coupling sleeve (12) which is fixable by means of a threaded tensioning element and which has an external thread at its free end which can be screwed to the vertical support (3).

17. Lighting system in accordance with claim 11, characterized in that for coupling of the vertical support (3) onto a tube mount the sleeve has an external thread for the screw connection with the corresponding tube mount in place of a connection flange.

* * * * *